United States Patent [19]

Santosuosso

[11] Patent Number: 4,901,484

[45] Date of Patent: Feb. 20, 1990

[54] ENCLOSURE FOR INGROUND SWIMMING POOL

[75] Inventor: Christopher J. Santosuosso, Everett, Mass.

[73] Assignee: Christopher Enclosure, Inc., Peabody, Mass.

[21] Appl. No.: 57,351

[22] Filed: Jun. 2, 1987

[51] Int. Cl.[4] ..... E04B 7/02

[52] U.S. Cl. ..... 52/90; 52/86; 52/63

[58] Field of Search ..... 52/90, 86, 87, 63, 64; 135/102

[56] References Cited

U.S. PATENT DOCUMENTS

| | | | |
|---|---|---|---|
| 3,683,427 | 8/1972 | Burkholz et al. | 135/102 X |
| 4,011,697 | 3/1977 | Fedolfi | 52/86 X |
| 4,051,638 | 10/1977 | Heintz | 135/102 X |
| 4,229,914 | 10/1980 | Lucas | 52/86 X |
| 4,274,234 | 6/1981 | Abell | 52/63 |
| 4,347,690 | 9/1982 | Wallace | 52/86 |
| 4,381,629 | 5/1983 | Ahn | 52/63 X |
| 4,622,950 | 11/1986 | Greenbaum | 52/63 X |
| 4,683,686 | 8/1987 | Ozdemir | 52/63 X |
| 4,694,543 | 9/1987 | Conley | 52/63 X |

*Primary Examiner*—Carl D. Friedman
*Assistant Examiner*—Creighton Smith
*Attorney, Agent, or Firm*—Frederick A. Goettel, Jr.

[57] ABSTRACT

An enclosure is provided for an inground swimming pool. The enclosure is a building like structure made up of vertical sidewalls including a fence portion and a ventilating window portion. The roof is made from a transluscent plastic supported on a skeleton-like framework.

40 Claims, 6 Drawing Sheets

ENCLOSURE FOR INGROUND SWIMMING POOL

BACKGROUND OF THE INVENTION

1. Field of the Invention

The present invention relates to a dome-like enclosure for an inground swimming pool which will permit use of the pool during virtually any weather and in any climate.

2. Description of the Prior Art

Every year thousands of new inground swimming pools are built in the backyards of American homes. As the number of swimming pools increase more and more people become aware of the limited season of use of an outdoor swimming pool, particularly in certain climatic regions of the country. Specifically, in temperate or cool weather areas, the usable swimming season may be no longer than two to two and a half months of the year.

Various pool enclosure structures are known in the prior art. Such structures however are generally very expensive for an individual homeowner. Many of such enclosures include complex folding structures or large sliding sectional panels to allow moving the structure away from the swimming pool in order to allow ventilation of the pool area on warm sunny days.

The structure of the present invention provides a simple, relatively low-cost, weather tight, enclosure system which will permit comfortable extension of the period of use of an inground swimming pool in temperate or cool weather areas. Used in some climates, the present invention may permit year round use of such a swimming pool.

The dome enclosure of the present invention in effect converts the swimming pool and the surrounding deck area into an effective solar collector during daylight hours, when the sun is shining. During nightime hours and cool daytime hours when the sun is not shining the enclosure serves as an insulating structure to prevent loss of heat from the pool water and the enclosure interior. Further benefit of the enclosure is that it renders the pool and the surrounding area safe, as well as dirt-free during brief or prolonged abscences of the owner.

Another substantial benefit of the present invention is that once the pool water has been elevated to a comfortable swimming temperature the pool may be used and thoroughly enjoyed during periods of inclement weather, which are not infrequent in most climates during the normal pool use season.

All of the benefits summarized above may be even further enhanced when the structure of the present invention is used in conjunction with a pool water heater. Use of a pool water heater allows the swimming pool water to be elevated to a comfortable level early in the season. Once the water temperature is elevated to such a temperature it may then be maintained at such a level by the solar heating capability of the present invention with a minimal investment in fuel costs for the pool heater after the initial warm-up period.

During periods of high temperature the enclosure of the present invention may be readily ventilated with outside air by simply opening the enclosure's sliding window panels to provide the desired ventilation.

The above noted objects and substantial advantages of the present invention will be evident as the description of the invention is set forth hereinbelow in detail.

SUMMARY OF THE INVENTION

The present invention relates to an enclosure for an inground swimming pool which has a planar structural deck completely surrounding the perimeter of the pool. The enclosure includes a plurality of vertically extending support channels. The vertically extending channels are supported at their lower ends by an enclosure base support structure which serves to anchor the lower ends of the channels and also serves to anchor the entire structure to the structural surface of the planar deck. Vertically extending sidewalls which may include transparent window sections are attached to the vertical support channels. The upper edges of the sidewalls define a rectilinear upper enclosure perimeter. A curvilinear dome-like roof structure engages the entire upper enclosure perimeter and extends vertically above the sidewalls to completely enclose a region above the enclosure perimeter. Accordingly, the swimming pool, the planar deck surface, the vertically extending sidewalls and the dome-like roof cooperate to define an interior volume completely enclosing the pool and deck surface.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will be best understood from the following description of the preferred embodiments when read in connection with the accompanying drawings wherein like numbers have been employed in the different figure to denote the same parts and wherein:

THE DESCRIPTION OF THE PREFERRED EMBODIMENT

Figure 1:
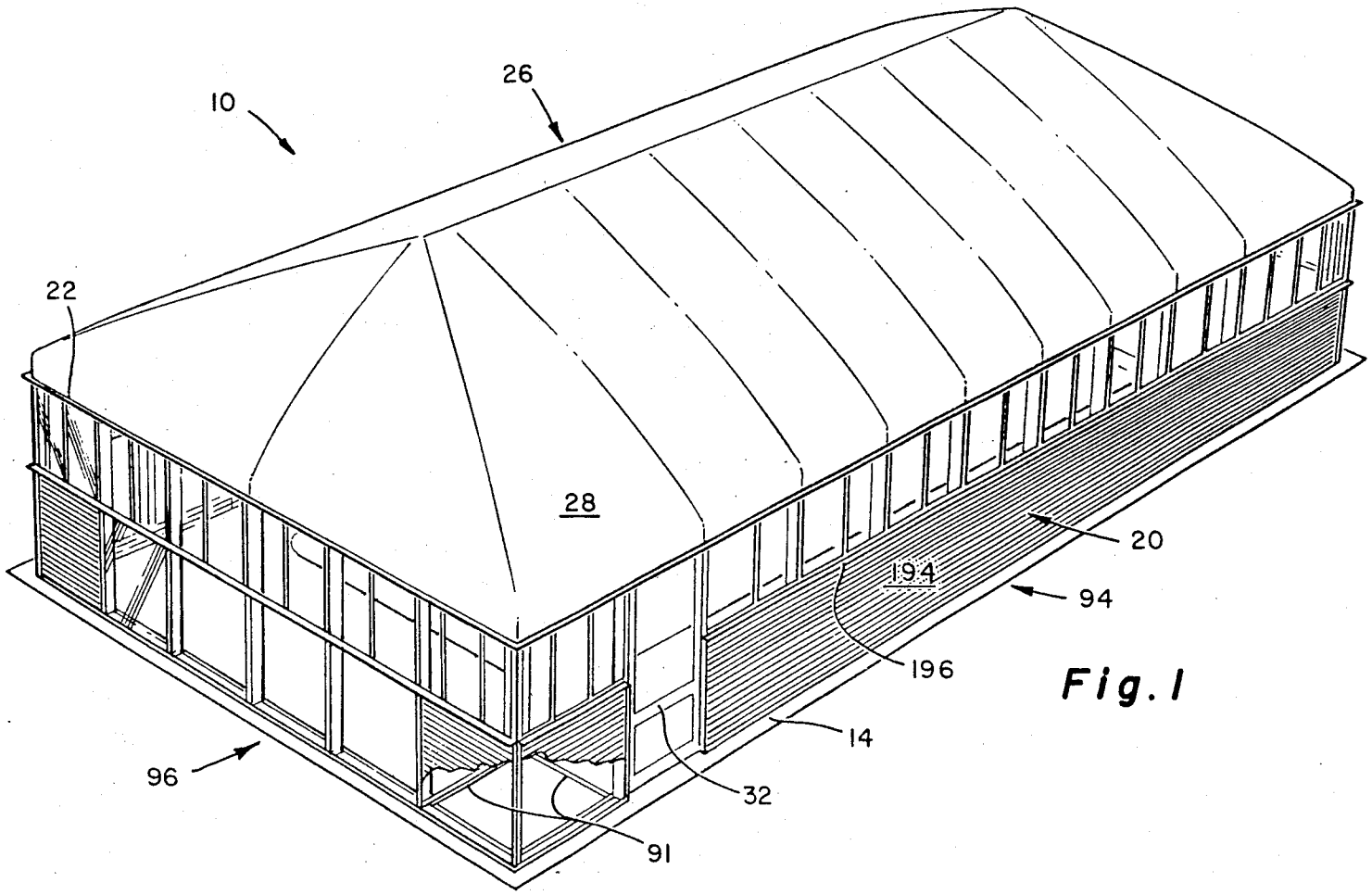
FIG. 1 is a perspective view of the swimming pool enclosure of the present invention.
Figure 2:
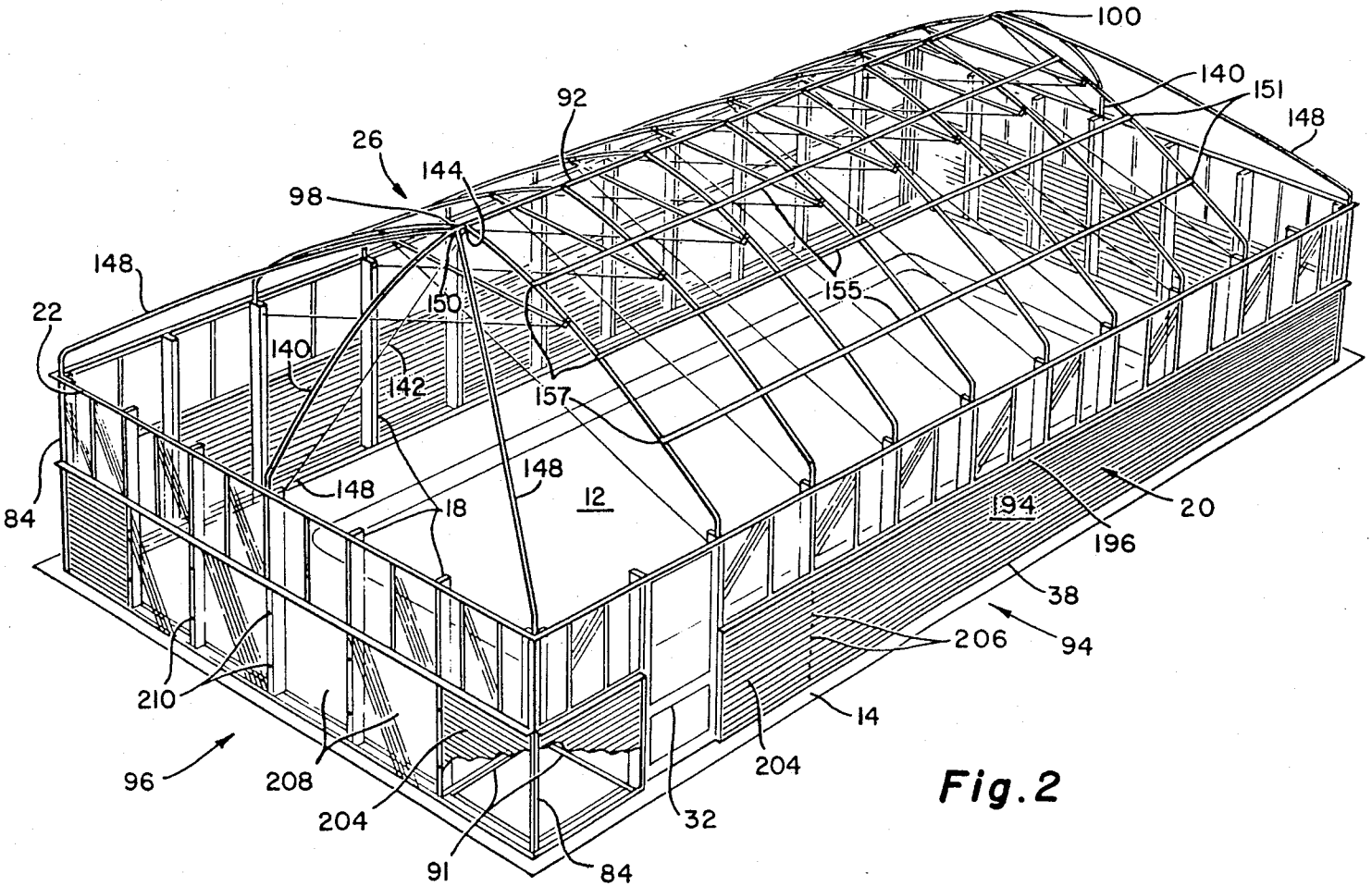
FIG. 2 is a perspective view of the enclosure of FIG. 1 with the translucent outer cover removed to show the interior detail of the enclosure structure.
Figure 3:
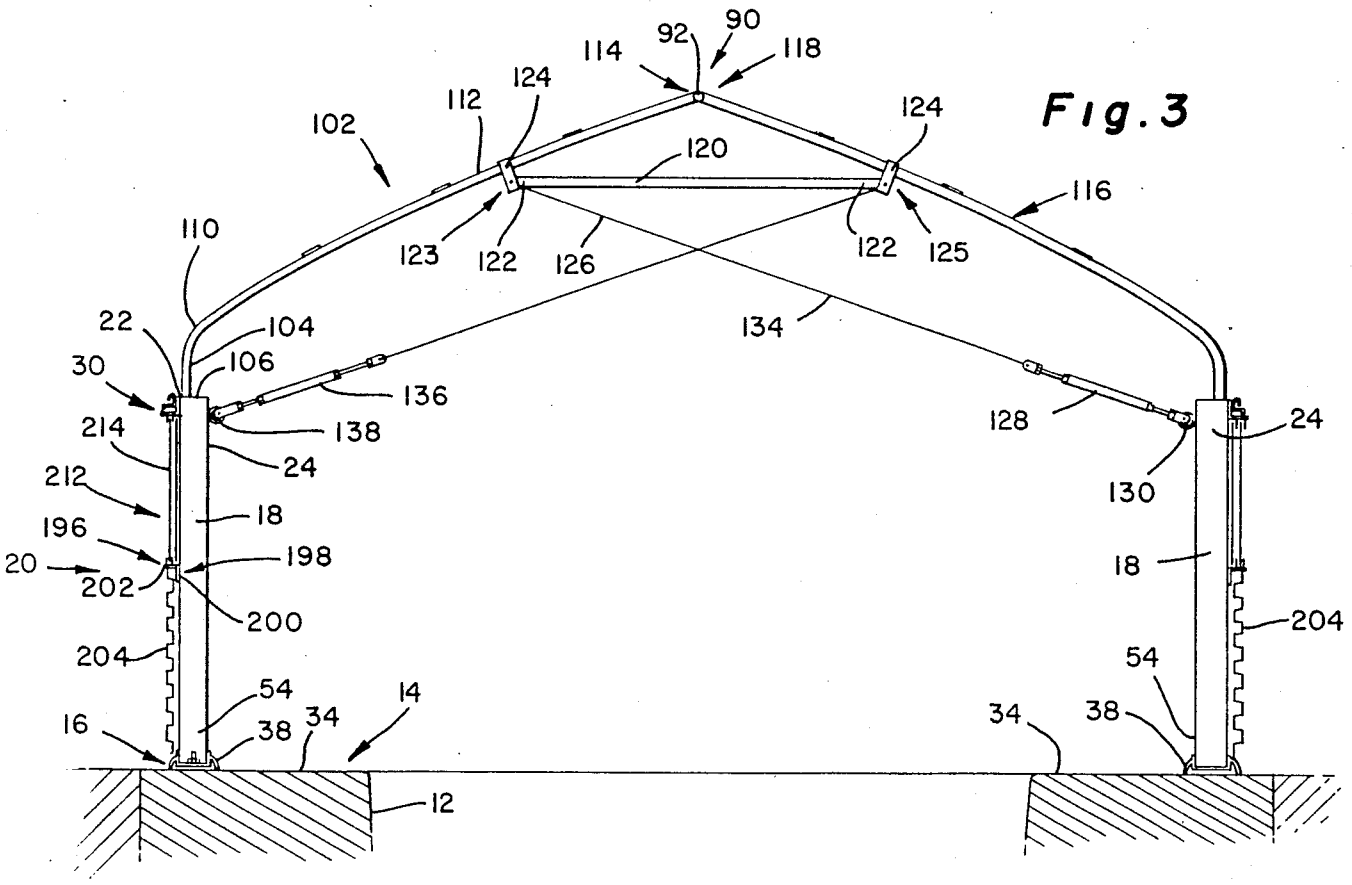
FIG. 3 is a typical vertical sectional view taken along the transverse axis of the enclosure.

Referring now to FIGS. 1, 2 and 3 a swimming pool enclosure 10 is constructed to overlie and completely enclose a swimming pool 12 and a surrounding planar structural deck surface area 14. The enclosure 10 basically comprises an enclosure base support structure generally designated 16 which defines a rectangular enclosure perimeter on the deck surface. The base support structure 16 is structurally attached to the deck surface and serves to support a plurality of vertically extending support channels 18. The vertically extending support channels 18 are positioned at substantially equally spaced intervals about the enclosure perimeter and serve to support vertically extending sidewalls 20.

The upper ends of the sidewalls define a closed upper enclosure perimeter 22 which is coextensive with the rectangular enclosure perimeter.

Extending upwardly from the upper enclosure perimeter and supported in a manner to be described in detail below, by the upper ends 24 of the vertical support channels 18 is a curvilinear dome-like roof 26 which completely encloses a volume lieing above a plane passing through the upper enclosure perimeter 22. Generally, the dome-like roof 26 comprises a supporting framework 27 defined by a plurality of tubular sections which structurally interconnect opposing sidewalls of the rectangular enclosure. The tubular sections defining the framework are reinforced by an overhead cross bracing system to be described in detail below. The framework serves to support an outer cover 28 fabricated from a flexible plastic material which is retained at its lower edges, in the region of the upper enclosure perimeter 22, by a retaining structure 30 again, which will be described in detail below.

A door 32 is provided in at least one of the sidewalls 20 to provide access to the interior of the enclosure.

Having described the overall structure of the enclosure in general terms a more detailed description of the enclosure will follow. For convenience of descriptions this will be broken down into three subsections.

ENCLOSURE BASE SUPPORT AND VERTICAL SUPPORT CHANNELS

As described hereinabove the enclosure base support 16 defines a rectangular enclosure perimeter on the planar deck surface 14 surrounding the pool 12. The enclosure perimeter is preferably large enough to provide a suitable walkway area 34 around at least three sides of the pool and an enlarged deck area 36 adjacent one end of the pool to accomodate chairs, tables, and etc. within the confines of the enclosure.

Figure 4:
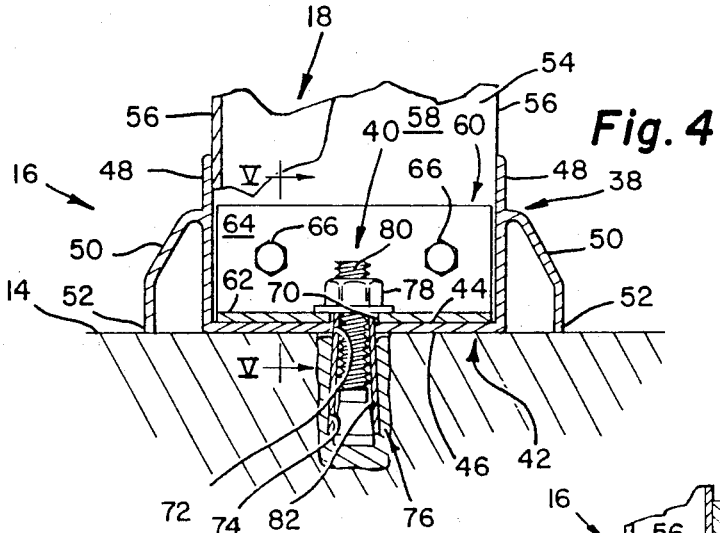
FIG. 4 is an enlarged sectional view of the lower end of a typical vertical support channel/base support structure/deck surface attachment.

The base support structure 16 comprises a number of sections of an elongated channel 38 of extruded structural aluminum which are attached to the deck surface. A break is provided in the enclosure perimeter, for safety reasons, only in the region of the access door 32. As best seen in FIGS. 3 and 4 the elongated channels 38 comprise a U-shaped section 40 which is defined by a flat bottom section 42 having an upper 44 and a lower 46 surface and a pair of vertical legs 48 extending upwardly from the opposite ends of the flat bottom section 42.

The lower surface 46 of the flat bottom 42 of the U-shaped section 40 is adapted to be in supportive confronting engagement with the planar deck surface 14. The elongated channel 38 further comprises a pair of stablizing projections 50. One of each of the stablizing projections 50 extends lateraly outwardly and downwardly from each of the vertically extending legs of the U-shaped section. The stablizing projections terminate in ends 52 which are positioned in substantially coplanar relationship with the lower surface 46 of the bottom 42 such that they will engage the deck surface 14 when the base section 38 is attached to the deck.

Each of the vertically extending support channels 18 is rectangular in cross section and their lower ends 54 are received in the U-shaped section support channel with a first pair of sides 56 in close confronting relationship with the inner facing sides of the vertical legs 48. As is evident from the drawing figures the second pair of sides 58 of the lower ends 54 of the vertical support channels 18 extend between the inner faces of the pair of vertical legs of the support channel 38.

Figure 5:
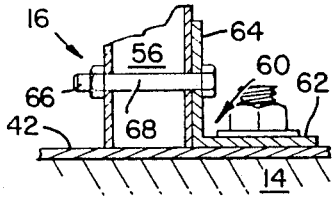
FIG. 5 is a partial sectional view taken along the line V—V of FIG. 4.

As best seen in FIGS. 4 and 5 attachment of the lower ends of the vertical support channels 18 to the base support channel 38 and in turn to the deck structure 14 is accomplished by use of a right shaped bracket 60 having a flat horizontal section 62 in confronting relationship with the upper surface 44 of the flat bottom 42 of the base support channel 38 and a flat, vertically extending section 64 which is in confronting relationship with one of the second pair of sides 58 of the vertically extending support channels 18. The vertically extending section 64 of the right angled bracket 60 is structurally interconnected to its associated support channel 18 by a suitable threaded fastening means 66 such as for example two ¼"-20 stainless steel nut and bolt fasteners extending through an opening 68 in the vertical leg 64 of the right angled channel and through an axially aligned opening in the vertical support channel 18.

A through opening 70 is provided in the horizontal section 62 of the right angled bracket which is in axial alignment with a through opening 72 provided in the bottom 42 of the U-shaped channel 40 in which it is in confronting contact with.

In the preferred embodiment the deck structure 14 is made from structural poured concrete. Anchoring of the base support structure 38 and the vertical channels 18 to the deck is achieved by boring a hole 74 in the concrete in axial alignment with the openings 70, 72 in the right angled bracket 60 and the base structure 38 and inserting into these openings a suitable structural expansive sleeve anchor device 76 of the type which is well known in the art. A prefered device for accomplishing such anchoring is a device known as a Rawl Loc/Bolt all steel sleeve anchor manufactured by the Rawlplug Company, Inc. As shown in FIG. 4, wherein such a device has been installed, the tightening of a threaded nut 78 on a threaded extension 80 of the fastener, following insertion into the concrete opening 74 causes expansion of the sleeve 82 of the device into positive locking engagement with the concrete deck thereby positively retaining the base structure 38 the right angled bracket 60 and the vertically extending channels 18 to the concrete deck 14. Again as is evident from FIG. 4 the lateraly extending stablizing projections 50 engage the upper surface of the deck 14 at positions lateraly spaced from the point of anchoring and serve to resist any rotational movement of the vertical channels 18 and the base 38 about the attachment points to the deck.

While a single vertical support channel 18 and its attachment to the base support channel 38 and the deck 14 has been described it should be appreciated that, with only several exceptions, which will be mentioned hereinbelow, each of the vertical support channels 18 is similarly structurally supported.

As mentioned in the previous paragraph not all of the vertical support channels 18 are supported as described above, specifically some of the vertical support channels are merely "filler" channels. Typically, such "filler" channels are attached to the pair of vertical legs 48 extending from the base support structure 38 by self-tapping screws. Such attachment is not shown specifically in the drawing figures however may be visualized with reference to FIG. 4 as extending through the portion of the vertically extending legs 48 which project above the stablizing projections 50.

Figure 6:
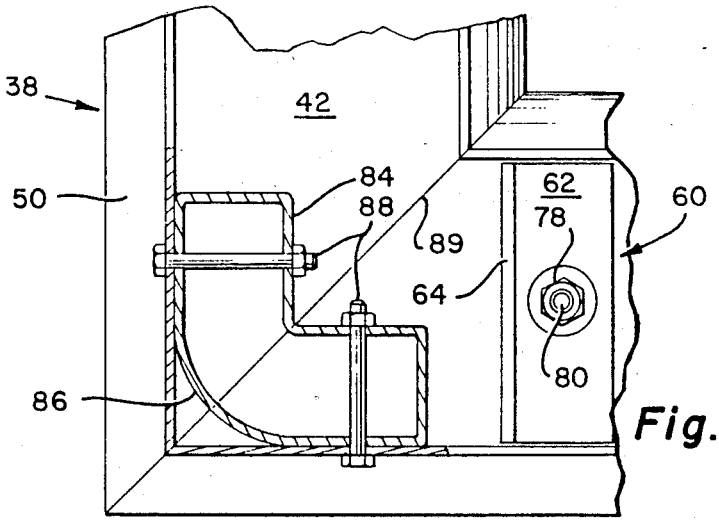
FIG. 6 is horizontal plan view through the lower end of a corner of the enclosure.

Another exception to the above described structural connection of the vertical support channels 18 includes the corner vertical channels 84. Refering to FIG. 6 it will be seen that these channels 84 comprise a special extrusion which for aesthetic purposes displays a rounded outside surface 86 at the four outside corners of the pool enclosure 10. The special corner vertical channels 84 are attached to the vertically extending legs 48 of the base channels by a pair of suitably sized nut and bolt assemblies 88 as shown in FIG. 6. The attachment of the vertical support channels 18, as described above, has proven to provide an extremely rugged structurally sound enclosure structure. The "filler" vertical channels and corner channel 84 obviously could be attached to the deck structure as described in the above paragraph with respect to the majority of the vertically extending channels 18 is desired.

Refering still to FIG. 6, it will be seen that a right angle bracket 60 is used to attach the base extrusion 38, adjacent a perimeter corner, to the deck 14. The full width contact of the horizontal leg 62 of the bracket 60 with the bottom 42 of the extrusion 38 serves to enhance the rigidity of the connection. Also in this view it will be seen that the ends of the base extrusion sections 38 which form the corners are bevelled at a 45° angle and are welded together as at 89.

Referring now to FIG. 1 or 2 it will be seen that a pair of diagonal supports 91 is provided at each of the four corners of the enclosure structure. The diagonal supports 91 are structurally attached by suitable means (not shown) at approximately the mid-points of the corner verticals 84 and near the lower ends of the adjacent vertical channel 18.

ROOF SUPPORT FRAMEWORK/COVER/COVER RETAINING STRUCTURE

For convenience of the following descriptions the pair of longer sides 94 of the rectangular enclosure 10 will be reffered to as the first pair of sides, and the pair of shorter sides 96 will be reffered to as the second pair of sides.

Referring now to FIGS. 1 and 2 the peak 90 of the framework-like roof support structure 27 is defined by a main tubing support section 92 which extends substantially horizontally in parallel relation with the first pair of sides 94 of the upper enclosure perimeter 22. The main tubing support section 92 is spaced substantially equidistant from each of the first pair of sides 94 and is shorter in length than the first pair of sides 96. Further, the axial ends 98, 100 of the main tubing support sections 92 are and is substantially equally spaced from each of the second pair of sides 96. As mentioned above the main tubing support section 92 defines the peak 90 of the roof support structure 27 and accordingly is positioned at an elevation above the upper enclosure perimeter 22.

Refering now to FIG. 3 the basic "building block" of the roof support structure 27 and its structural relationship with the vertically extending supports 18 will be described in detail For reference purposes, the right hand vertically extending support channel 18 in FIG. 3 lie in one of the first pair of sides 94 described hereinabove while the left hand vertical channel 18 in FIG. 3 lies in the other of that first pair of sides 94. The reference to left and right will be used in the description of FIG. 3 to further simplify the description. The main tubing support section 92 is seen in FIG. 3 as simply a circular cross section which, obviously, defines the peak 90 of the roof support structure 27.

Figure 8:
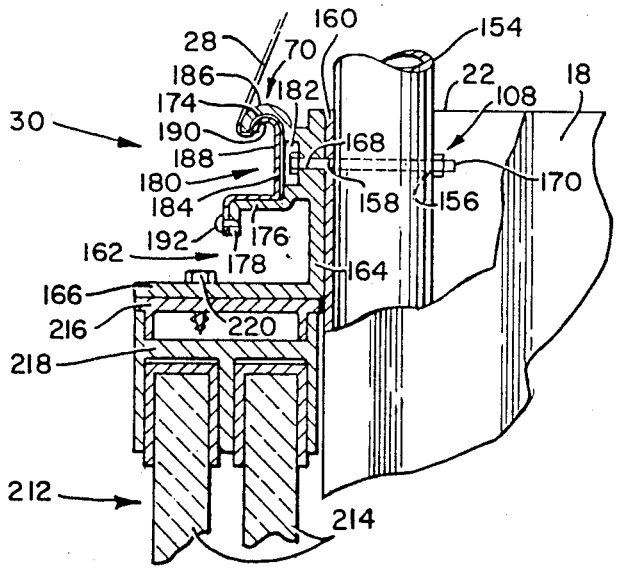
FIG. 8 is an enlarged typical sectional view of the cover retaining structure.

With the continued reference to FIG. 3 the structure shown includes a left hand lateral tubing section 102 which comprises a substantially vertical section 104 which is received in the open upper end 106 of the lefthand vertical support channel 18. The vertical section 104 of the lateral tubing section to the vertical channel 18 by a suitable bolted connection 108 as best seen in FIG. 8. The vertically extending portion extends upwardly and into an arcuate shaped bend 110 to a curvilinear section 112 which continues upwardly and inwardly and terminates in structurally positive connection 114 with the main tubing support section 92.

A right hand lateral tubing section 116 extends from the right hand vertical support channel 18 where it is supported in the open end 106 thereof by a suitable bolted connection 108 and extends from that point in a manner identical to the left hand lateral tubing section 102 to the main tubing support section 92 where it is likewise structurally connected to the main tubing support section 92 at a location 118 substantially adjacent the connection 14 of the left hand lateral section.

Figure 9:
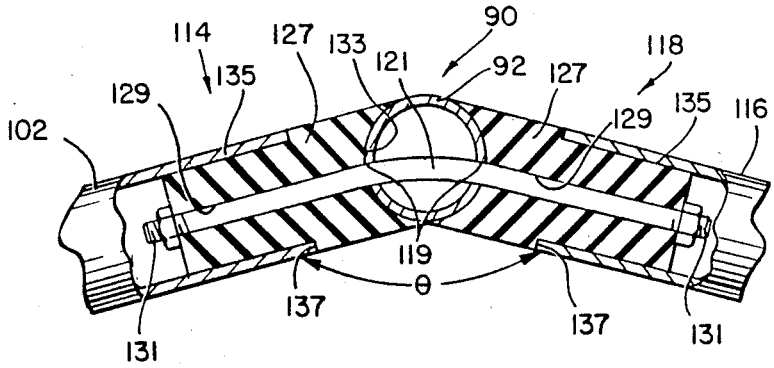
FIG. 9 is an enlarged view, partially broken away, showing the attachment of a pair of lateral support tubes to the main tubing support sections.

FIG. 9 shows, in detail the connections 114, 118 of the left and right hand tubing sections 102, 116 to the main tubing sections 92. A pair of openings 119 are located in the main tubing support sections 92. The openings 119 are angularly displaced from one another by an angle $\theta$ which it is desired that the tubing sections 102, 116 form with ane another. An elongated rod 121 threaded at both ends and bent at the same angle is inserted through the openings 119. A cylindrical nylon insert 127 having an axial opening 129 therethrough is placed on each threaded end of the rod 121 with a threaded end 131 extending from each opening 119. The ends 133 of the inserts 127 which are adjacent the support 92 are arcuately shaped to engage the support 92 in mating relationship. Nuts are threaded out each end 131 to retain the inserts 127 in the desired angular position.

Each insert 127 is provided with a reduced diameter section 135 and a circumferential stop 137. The reduced diameter section 135 is sized to be snuggly recieved in the open end of a lateral tube 102, 116 with the end of the tube bearing on the circumferential stop 137.

A horizontal cross bar 120 extends between the left and right hand lateral tubing sections 102, 116 and is structurally connected at its opposite ends to the tubing sections at an elevation underlieing the peak 90 of the structure. The cross bars 120 are typically made from a structural aluminum component having a circular cross section and flattened ends 122. The flattened ends facilitate attachment by clamp-like straps 124 which encircle the left and right hand lateral tubing sections 102, 116 to thereby positively structurally attach the cross bars thereto. Such attachment is made by a suitable stainless steel nut and bolt assambly extending through aligned openings in the straps and and the ends 122 of the cross bars 120.

Looking at the attachment 123 of the left hand end 122 of the horizontal cross bar 120 to the left hand lateral tubing section 102 it will be seen that a stainless steel reinforcing cable 126 is structurally attached at such connection point. In the illustrated embodiment the connection is made to the bolt which passes through the attaching strap 124 and through the flattened end of left hand end of the horizontal cross bar. This stainless steel cable 126 extends from this point to the right as viewed in FIG. 3 under the cross bar 120 where it is structurally attached to one end of a stainless steel turnbuckle assembly 128 which in turn is structurally attached by a suitable eye-bolt and nut assembly 130 to the upper end 132 of the right hand vertically extending support channel 18. In a similar manner a second stainless reinforcing cable 134 extends from the attachment point of the right end of the horizontal cross bar 120 to the right hand lateral tubing section 116 in a manner identical to that described with respect to the other reinforcing cable. From that point the cable 134 extends to the left under the horizontal cross bar 120 crisscrossing the first reinforcing cable 126 and into connection with a second stainless steel turnbuckle assembly 136 which in turn is connected through an eye-bolt and nut assembly 138 to the upper end 132 of the left hand vertically extending support channel 18.

It will be appreciated with reference to FIG. 3 that the combination of the two vertically extending support channels 18 and their structural connection to the structural deck 14 as described in the section above dealing with that structure, in combination with the above described tubing and cable support structure provides an extremely structurally rigid assembly which is also an aesthetically appealing structure. Turning now to FIG. 2 it will be appreciated that the enclosure illustrated in the present embodiment includes a plurality of tubing/-cable support arrangements identical to that described hereinabove.

With reference now to FIG. 2 it will be seen that the roof support structure 27 further includes a pair of end tubing sections 140 which extend from the open upper ends of a vertically extending support channel 18 on the second pair of sides 96 of the enclosure to a structural attachment point at the opposite axial ends 98 of the main tubing support sections 92. Each of the end tubing support sections 140 also has associated therewith a stainless steel reinforcing cable 142 which extends from a structural attachment point 144 adjacent the end tubing sections attachment to the main tubing support channel 18 downwardly wherein it is attached to a stainless steel adjustable turnbuckle 146 which in turn is attached to the same vertically extending support channel 18 which supports the other end of the respective end tubing sections 140.

Again with reference to FIG. 2, extending from the open end of each of the corner vertical support channels 84 is a corner tubing section 148 which extends in a manner similar to the lateral tubing sections upwardly towards the peak 90 wherein it is structurally attached to a point 150 adjacent the axial end 98 of the main tubing support section 92 which is in closest proximity to the corner in which the corner tubing section 148 originated. Thus, as illustrated in FIG. 2, there are four tubing sections coming together at each end 98 of the main tubing support section 92. Five tubing sections maybe joined at this point by means of a five way coupling. In the preferred embodiment, the four sections, i.e. one end 98 of the main support tubing 92, one end support tubing 140, and two corner tubing support sections 148 are interconnected by a four-way coupling (not shown).

Looking at FIGS. 2 and 3 a plurality of elongated, flexible support straps 155 are positioned in a overlying relation to the plurality of lateral support tubes 102, 116. In the illustrated embodiment three straps are shown on each set of lateral support tubes. The straps are attached to the tubes at their ends 157 and are drawn sufficiently taut to prevent drooping of the flexible cover 28.

Looking now at FIG. 8, the upper end 132 of a typical vertically extending support channel 18 is shown partially broken away with the end of a representative lateral tubing section 154 received therein. As is evident the lateral tubing section is provided with an opening 156 there through which is in axial alignment with an opening 158 in the outside facing wall 160 of the support channel 18.

Mounted on the outside facing wall 160 of the vertical support channel 18 at the uppermost end thereof, is an elongated structural aluminum extrusion 162 which forms a part of the cover retaining structure. As will be seen, this extrusion 162 also serves to support the window sections which form a part of the sidewalls 20.

The extrusion 162 comprises a right angled section which includes a vertical leg 164 which is in confronting relation with the outside wall 160 of the vertical support channel 18 and a horizontal leg 166 which extends outwardly from the lower end of the vertical leg 164.

As is clearly evident from FIG. 8, the vertical leg 164 of the extrusion 162 is provided with an opening 168 therethrough which is in axial alignment with the openings 158, 156 in the upper end of the vertical support channel 18 and the lateral tubing sections 154, respectively. A single nut and bolt assembly 170 extends through the openings 158, 156 and 168 and serves to structurally support each of these components as shown near the upper enclosure perimeter 22.

Located at the upper end of the vertical leg 164 of the extrusions 162 is a cover retaining channel 172. The cover retaining channel 172 comprises a downwardly facing U-shaped section, forming the top of the channel. The bottom of the channel is formed by a dog-leg section comprising an outwardly extending horizontal leg 176 and a short downwardly extending vertical leg 178. The inwardly facing surfaces of the sections which make up the cover retaining channel define what is referred to as the cover receiving groove. The cover receiving groove includes a recessed portion therein to provide clearance for the head of the bolts of the nut and bolt assemblies 170.

With continuing reference to FIG. 8, it will be seen that the lower edge 184 of the flexible plastic cover material 28 extends around the outside end 186 of the U-shaped section 174 of the cover retaining channel 172 and into the cover receiving groove 180. The lower edge 184 of the cover is positively retained and caused to conform to the contour of the cover receiving groove 180 by a cover retention insert 188. The cover retention insert 188 is sized to fit within the cover receiving groove and to conform to the interior surfaces of the cover receiving groove 180 and, further, to conform to the horizontal and vertically extending sections 176, 178 defining the dog-leg section at the lower end thereof. It will accordingly be appreciated that the lower edge 184 of the cover is positively retained by this structure by stretching the lower end of the cover material outwardly around the inverted U-shaped end and into the cover retaining groove and thereupon sandwiching the cover into the groove by insertion of the cover retention insert into the groove. The upper end 190 of the cover retention insert 188 which mates with the U-shaped portion 174 of the cover retaining channel serves to retain the upper end of the cover retention insert and the lower end thereof is positively attached to the vertically extending portion of the dog-leg by a suitable threaded connecting means 192, as illustrated. It will of course be appreciated that the cover retaining structure, 30, illustrated in FIG. 8 and described in detail hereinabove extends around the entire upper enclosure perimeter, 22, of the swimming pool enclosure, 10, of the present invention.

Figure 10:
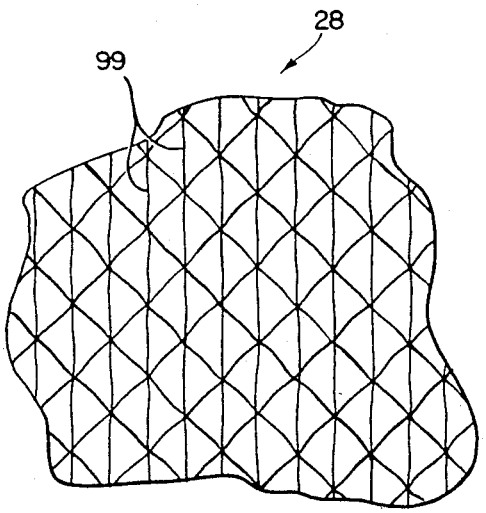
FIG. 10 is a showing of the cover material.

The flexible plastic outer cover 28 is shown installed on the framework of the enclosure and retained by the above described cover retaining structure, 30 in FIG. 2. A representative portion of the cover which is fabricated from a heavy-duty reinforced vinyl material that is extremely strong, extremely durable, and translucent is shown in FIG. 10. Such features allow the sun's warming rays to pass directly through the cover and help raise both the air and water temperature inside the enclosure. The strength of the heavy-duty reinforced vinyl and the structural integrity of the roof supporting framework enables the cover to act as a solar collector while at the same time enabling the cover to easily shed rainwater, snow, sleet, and hail and to withstand extremely high windloads. The preferred material for fabricating the translucent vinyl cover is an extremely heavy gauge vinyl material which has a matrix shaped fiberglass reinforcing material 99, including weft and warp, as well as diagonally disposed reinforcing fibers, embedded therein. The material accordingly is extremely strong and resistant to any distortion and/or ripping. The material further lends itself to readily making joints as necessary through conventionally known adhesive and heat sealing techniques, thus allowing fabrication of the necessary curved sections of the cover at the ends thereof. The preferred material for use in fabricating the cover is marketed under the tradename Kearspan, as catalogue number PVR-1444K by the Snyder Manufacturing Company of Dover, Ohio.

SIDEWALLS-FENCE/WINDOWS/DOOR

Referring now to FIGS. 1, 2, and 3, it will be seen that the vertically extending sidewalls, 20, are attached to the outside surfaces of the plurality of vertically extending support channels, 18, and extend about the entire outside perimeter of the enclosure. As has been previously indicated, a door, 30, provides access to the interior of the enclosure. The door is preferably located at an end of the enclosure adjacent an enlarged portion of the planar deck surface 14. The door, in the preferred embodiment, is a commercially available aluminum storm door which is mounted between a pair of vertically extending support channels in a conventional fashion. In the illustrated embodiment the door extends from the deck surface 14 to the upper enclosure perimeter, 22. It will of course be understood that additional doors may be provided in an enclosure, as desired without affecting the structural integrity of the enclosure.

The vertically extending sidewalls 20 comprise a fence portion which extends from the lower enclosure perimeter in contact with the upper ends of the vertically extending portions 48 of the base support structure 16 to a fence top perimeter 196 located approximately half-way between the enclosure perimeter and the upper enclosure perimeter 22. The fence top perimeter 196 is defined by a right-angled aluminum channel 198 having a vertical section 200 attached to the outer surface of the vertically extending support channels 18 and a horizontal section 202 extending outwardly from the upper end of the first section. This channel is approximately the same size as the horizontal leg 166 of the extrusion 162 associated with the top retaining structure, 30.

The fence itself comprises fiberglass panels or transparent window panels attached to and structurally supported by the vertically extending support channels with the upper edges thereof lying in the interior angle of the right-angled channel 198 defining the fence top perimeter. In a preferred embodiment, at least a portion of the panels comprise corrugated fiberglass panels 204 which are attached to the vertical support channels, 18, by a series of self-tapping sheet metal screws and washer fasteners 206. In the preferred embodiment, another portion of the fence panels comprise a plurality of rectangular transparent window panels 208. Specifically, the windows are tempered glass windows mounted in aluminum perimeter frames which are attached to their supporting vertical support channels by conventional attachment means 210 such as the retaining members used for attaching removable storm window panels to a storm door frame. A plurality of such tempered glass panels 208 are shown on the left hand end of the enclosure structure as it appears in FIGS. 1 and 2.

The remainder of the fence 194 shown in the drawing figures are comprised of corrugated translucent structural fiberglass panels 204 of a type which is readily commercially available. It should be appreciated that while the fence top perimeter 196 is shown as being approximately midway between the base enclosure perimeter and the upper enclosure perimeter, that the perimeter 196 could be located anywhere between one-third and two-thirds of the distance between these perimeters and still result in an aesthetically pleasing structure.

Extending from the fence top perimeter 196 upwardly to the upper enclosure perimeter 22 is the window portion 212 of the vertically extending sidewalls 20. In the preferred embodiment the window portions 212 comprise a plurality of commercially available glass window sections 214 mounted in heavy-duty aluminum frames 216. The dimensions of the frames 216 are selected such that a single frame unit will fit between two adjacent vertically extending support channels 18.

Referring now to FIGS. 3 and 8, it will be seen that the window sections 212 are supported at the top by the horizontal legs 166 of the extrusions 162, and at the bottom by the horizontal section 202 of the channel 198 forming the fence top perimeter 196. The window frames 216 are attached to the legs 166 and 202 by a plurality of sheet metal screws 220 as shown at one representative location in FIG. 8.

Figure 7:
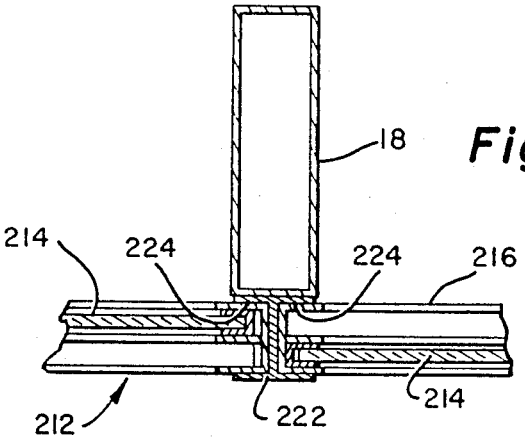
FIG. 7 is a partial horizontal sectional plan view through a typical vertical support channel and window support frame.

Looking now at FIG. 7 an H-shaped channel 222 is attached to the outside end of a vertical support channel 18. The H-shaped channel 222 defines a pair of window assembly receiving channels 224. A window assembly 212 is received channel to help support the window assemblies and to fill the gap between adjacent window assemblies.

Turning back to FIG. 8, it will be seen that each of the window support frames 216 includes a section 218 defining a pair of window support channels therein. Each of these channels supports, in a sliding fashion, one of the tempered glass window sections 214. Each window section 214 extends approximately half the width of the aluminum frame 216. Accordingly, each of the windows sections 214 may be independently horizontally slidably displaced within its respective channel to selectively open and close the window sections 214 as desired.

While not shown in the embodiment shown, it should be understood that screen panels may be readily substituted for the window panels shown herein.

Because the sliding window structures used are commercially available sizes there may be cases where a commercially available size is not available to completely fill the distance between vertical 18. Such is the case in the four corner 154 of the illustrated embodiment of the enclosure. With reference to the window portion to the left of the enclosure access door 32 it will be seen that a sliding window unit less than the distance from the door to the corner post 84 mounted in this region. The space from the left hand edge of the sliding window unit to the corner post 84 in this embodiment is filled by a transparent panel made from, for example, plexiglass, lexan or tempered glass. Such arrangement is used at the other corners of the structure and may be readily used to facilitate building an enclosure of varying dimensions while still maintaining the benefits of using commercially available sizes of sliding tempered glass window units.

Accordingly, it should be appreciated that the above described invention provides a simple, relatively low cost, weather tight enclosure system which will permit comfortable extension of the period of use of an in-ground swimming pool. The described dome enclosure converts the swimming pool and the surrounding deck area into an effective solar collector, which serves not only to collect, but efficiently heat therein. The structure allows such benefits while also readily allowing free cross ventilation of the enclosure by opening of the slidibly mounted window structures.

This invention may be practiced or embodied in still other ways without departing from the spirit or essential character thereof. The preferred embodiments described herein are therefore illustrative and not restrictive, the scope of the invention being indicated by the appended claims and all variations which come within the meaning of the claims are intended to be embraced therein.

What is claimed is:

1. An enclosure for a swimming pool, the pool having a planar structural deck surface completely surrounding the pool perimeter, said enclosure comprising:

a plurality of vertically extending support channels, each having a lower and upper end;

an enclosure base support structure defining a rectilinear enclosure perimeter on the planar deck surface, said base support structure comprising; means for structurally supporting said lower ends of said plurality of support channels and for interconnecting said support channels to the structural deck surface, in spaced-apart relationship around said rectilinear perimeter;

vertically extending substantially rigid sidewalls structurally attached to and supported by said vertically extending support channels, said sidewalls having upper edges which co-operate to define a closed upper enclosure perimeter substantially co-extensive with said rectilinear enclosure perimeter, said sidewalls including a plurality of windows which may be opened to provide ventilation;

a curvilinear shaped dome-like roof means attached to substantially the entire upper enclosure perimeter of said vertically extending sidewalls to completely enclose a volume lying above a plane passing through said upper enclosure perimeter, said roof means comprising a plurality of curvilinear shaped tubing sections, at least one free end of each of said tubing sections being fixedly attached to the upper end of one of said vertical support channels, said plurality of tubing sections co-operating with one another to define a fixed structurally rigid skeleton-like support structure; and wherein said dome-like roof means further comprises a cover made from a flexible plastic material supported by said skeleton-like structure and; means for retaining the lower edges of said cover at a position substantially adjacent said upper enclosure perimeter; and means located in one of said sidewalls, for providing access to the interior of said enclosure;

whereby the pool, the planar deck surface, said vertically extending sidewalls and said dome-like roof means co-operate to define an interior volume enclosing the pool and deck surface.

2. The enclosure of claim 1 wherein said means for retaining the lower edges of said cover comprises: a cover retaining channel having a cover recieving groove therein, said cover retaining channel being attached to the outside of said vertically extending support channels at the upper ends thereof, adjacent said upper enclosure perimeter; and, a cover retention insert adapted to be received in removable mating relationship in said cover retaining groove with said cover edge sandwiched between said cover retaining insert and said cover retaining channel; and, means for removably retaining said cover retaining insert in said cover retaining channel to thereby positively retain the lower edges of said cover.

3. The enclosure of claim 2 wherein said means for removably retaining comprises an interlocking arrangement between a portion of said cover retention insert and a portion of said cover retaining channel; and removable fastening means for holding said portions in said interlocking relationship.

4. The enclosure of claim 1 wherein each of said vertical channels has an open upper end which is adapted to operatively receive said free ends of said tubing sections which are attached thereto.

5. The enclosure of claim 4 wherein said means for retaining the lower edges of said cover comprises: a cover retaining channel having a cover recieving groove therein, said cover retaining channel being attached to the outside of said vertically extending support channels at the upper ends thereof, adjacent said upper enclosure perimeter; and, a cover retention insert adapted to be received in removable mating relationship in said cover retaining groove with said cover edge sandwiched between said cover retaining insert and said cover retaining channel; and, means for removably retaining said cover retaining insert in said cover retaining channel to thereby positively retain the lower edges of said cover.

6. The enclosure of claim 5 wherein said means for removably retaining comprises an interlocking arrangement between a portion of said cover retention insert and a portion of said cover retaining channel; and removable fastening means for holding said portions in said interlocking relationship.

7. The enclosure of claim 5 wherein said rectilinear enclosure perimeter and said upper enclosure perimeter are rectangles.

8. The enclosure of claim 7 wherein said skeleton-like support structure comprises a main tubing support section which extends substantially horizontally and in parallel relation to a first pair of sides of said upper enclosure perimeter rectangle, and, which is spaced substantially equidistant from each of said first pair of sides, said main tubing support section being shorter in length than said first pair of sides and being substantially equally spaced from each of the second pair of sides of said rectangle, said main tubing support section being positioned at an elevation above said plane passing through said upper perimeter to define the peak of said support structure; and wherein a portion of said plurality of curvilinear shaped tubing sections comprises a pair of lateral tubing sections, the first of said lateral tubing sections of each pair of lateral sections extending from its support by vertical support channel on said first pair of sides to a structural attachment point on said main tubing support section, the other of said tubing sections of each pair of sections extending from its support by a main support channel on the other of said first pair of sides to a structural attachment point on said main tubing support section at a position closely adjacent and opposing the structural attachment point of the first of said lateral tubing sections.

9. The enclosure of claim 8 including a plurality of horizontal cross bars, one of said horizontal cross bars extending between each of said pairs of lateral tubing sections, opposite ends of each of said horizontal cross bars being structurally connected, respectively, to the first of and the other of each of said pairs of lateral tubing sections, said cross bars being positioned at an elevation lieing between said peak and said upper enclosure perimeter.

10. The enclosure of claim 9 including a plurality of lateral reinforcing cables, the first cable of each of said pairs of lateral cables being structurally connected at one end thereof to the connecting point of one end of one of said horizontal cross bars to one of said pairs of lateral tubing sections and extending from said connection across the center of said enclosure where it is structurally attached, at the other end thereof, to the upper end of the vertically extending support channel supporting the other of said pair of lateral tubing sections; the second cable of each of said pairs of lateral cables being structurally connected at one end thereof to the connecting point of the end of one of said horizontal cross-bars to the other of said pair of lateral tubing sections and extends across the center of said rectangular enclosure where it is structurally attached to the upper end of the vertically extending support channel supporting said one lateral tubing section.

11. The enclosure of claim 10 wherein each of said lateral reinforcing cables includes a turnbuckle disposed along the length thereof to permit the adjustment of the length of each of said lateral cables.

12. The enclosure of claim 8 wherein said plurality of curvilinear shaped tubing sections further include at least one pair of end tubing sections one of said pair of end tubing sections extending from its support by a vertical support channel on one of said second pair of sides to a structural attachment point adjacent one said axial end of said main tubing support section and the other of said pair of end tubing sections extending from its support by a vertical support channel on the other side of said second pair of sides to a structural attachment point adjacent the other axial end of said main tubing support sections.

13. The enclosure of claim 12 wherein one of said vertically extending support channels is located at each of the four corners of said rectangular enclosure perimeter, and wherein a portion of said plurality of curvilinear shaped tubing sections comprise corner tubing sections, one of said corner tubing sections extending from its support by each of said corner vertical support channels to a structural attachment point adjacent the axial end of said main tubing support section which is in closest proximity to the respective corner vertical support channels.

14. The enclosure of claim 13 including a plurality of horizontal cross bars, one of said horizontal cross bars extending between each of said pairs of lateral tubing sections, opposite ends of each of said horizontal cross bars being structurally connected, respectively, to the first of and the other of each of said pairs of lateral tubing sections, said cross bars being positioned at an elevation lieing between said peak and said upper enclosure perimeter.

15. The enclosure of claim 14 including a plurality of pairs of lateral reinforcing cables, the first cable of each of said pairs of lateral cables being structurally connected at one end thereof to the connecting point of one end of one of said horizontal cross bars to one of said pairs of lateral tubing sections and extending from said connection across the center of said enclosure where it is structurally attached, at the other end thereof, to the upper end of the vertically extending support channel supporting the other of said pair of lateral tubing sections; the second cable of each of said pairs of lateral cables being structurally connected at one end thereof to the connecting point of the end of one of said horizontal cross-bars to the other of said pair of lateral tubing sections and extends across the center of said rectangular enclosure where it is structurally attached to the upper end of the vertically extending support channel supporting said one lateral tubing section.

16. The enclosure of claim 15 wherein each of said lateral reinforcing cables includes a turnbuckle disposed along the length thereof to permit the adjustment of the length of each of said lateral cables.

17. The enclosure of claim 16 including a pair of end reinforcing cables associated with each of said pairs of end tubing sections, the first cable of each of said pairs of end cables being structurally connected at one end thereof at a location adjacent the connection of one of said pairs of end tubing sections to said main tubing support sections and being structurally connected at the other end thereof to the upper end of the vertical support channel supporting the other end of the same end tubing sections; and the second cable of each of said pairs of end cables being structurally connected at one end thereof at a location adjacent the connections of the other of said pair of end tubing sections to said main tubing support sections, and being structurally connected at the other end thereof to the upper end of the vertical support channel supporting the other end of said other end tubing support sections.

18. The enclosure of claim 17 wherein each of said end reinforcing cables includes a turnbuckle disposed along the length thereof to permit the adjustment of the length of each of said cables.

19. The enclosure of claim 18, wherein said vertically extending sidewalls comprise: a fence portion extending from said rectilinear enclosure perimeter, adjacent the deck surface, upwardly to a fence top perimeter, said fence top perimeter being located between one-third and two-thirds the distance between said rectilinear enclosure perimeter and said upper enclosure perimeter, and; a window portion extending from said fence top perimeter to said upper perimeter.

20. The enclosure of claim 19 wherein said base support structure comprises an elongated channel comprising a U-shaped section adapted to receive the lower ends of said vertical support channels therein, said U-shaped sections being defined by a flat bottom having upper and lower surfaces and a pair of vertical legs extending upwardly from opposite ends of said flat bottom, said lower surface of said flat bottom being adapted to be supported by the planar deck surface; said elongated channel further comprising a pair of stablizing projections, each of said projections extending laterally outwardly and downwardly from one of said vertical legs, each of said stablizing projections terminating in a planar deck surface engaging end which is in coplanar relationship with said lower surface of said flat bottom.

21. The enclosure of claim 8, wherein said vertically extending sidewalls comprise: a fence portion extending from said rectilinear enclosure perimeter, adjacent the deck surface upwardly to a fence top perimeter, said fence top perimeter being located between one-third and two-thirds the distance between said rectilinear enclosure perimeter and said upper enclosure perimeter, and; a window portion extending from said fence top perimeter to said upper perimeter.

22. The enclosure of claim 21 wherein said window portion comprises a plurality of transparent window panels.

23. The enclosure of claim 22 wherein a portion of said window panels are horizontally slideably movable with respect to other window panels to permit opening thereof to thereby allow variable outside air ventalation of said interior volume.

24. The enclosure of claim 8 wherein said base support comprises an elongated channel comprising a U-shaped section adapted to receive the lower ends of said vertical support channels therein, said U-shaped sections being defined by a flat bottom having upper and lower surfaces and a pair of vertical legs extending upwardly from opposite ends of said flat bottom, said lower surface of said flat bottom being adapted to be supported by the planar deck surface; said elongated channel further comprising a pair of stablizing projections, each of said projections extending laterally outwardly and downwardly from one of said vertical legs, each of said stablizing projections terminating in a planar deck surface engaging end which is in coplanar relationship with said lower surface of said flat bottom.

25. The enclosure of claim 24 wherein at least the lower end of each of said vertically extending support channels is rectangular in cross section, said rectangular lower end having a first pair of sides in close confronting relationship with the inner facing sides of said pair of vertical legs and a second pair of parallel sides extending between the inner faces of said pair of vertical legs; and, wherein said means for structurally supporting and for interconnecting comprise: a right angle shaped bracket having a first section in confronting relationship with said upper surface of said flat bottom and extending between said inner surfaces of said vertical legs and a second vertically extending section in confronting relationship with one of said second pair of sides; and means for structurally interconnecting said vertically extending section of said right angled bracket to said one side of said second pair of sides in which it is in confronting relationship; and a threaded fastening means extending through an opening provided in said first section of said right angled bracket downwardly through an axially aligned opening in the bottom of said U-shaped section and into structural positive engagement with the planar structural deck surface.

26. The enclosure of claim 4 wherein said flexible plastic material includes a matrix of reinforcing fibers embedded therein.

27. The enclosure of claim 26 wherein said flexible plastic material is a translucent heavy guage vinyl, and said reinforcing fibers comprise a matrix of fiberglass fibers.

28. The enclosure of claim 1, wherein said vertically extending sidewalls are attached to the exterior of each of said vertical support channels.

29. The enclosure of claim 1, wherein said vertically extending sidewalls comprise: a fence portion extending from said rectilinear enclosure perimeter, adjacent the deck surface, upwardly to a fence top perimeter, said fence top perimeter being located between one-third and two-thirds the distance between said rectilinear enclosure perimeter and said upper enclosure perimeter, and; a window portion extending from said fence top perimeter to said upper perimter.

30. The enclosure of claim 29 wherein said fence portion comprises a plurality of fiberglass panels.

31. The enclosure of claim 30 wherein said fiberglass panels are corrugated.

32. The enclosure of claim 29 wherein said fence portion comprises one or more rigid transparent panels and one or more fiberglass panels.

33. The enclosure of claim 32 wherein said fiberglass panels are corrugated.

34. The enclosure of claim 29 wherein said window portion comprises a plurality of transparent window panels.

35. The enclosure of claim 34 wherein a portion of said window panels are horizontally slideably movable with respect to other window panels to permit opening thereof to thereby allow variable outside air ventalation of said interior volume.

36. The enclosure of claim 1 wherein said base support structure comprises an elongated channel comprising a U-shaped section adapted to receive the lower ends of said vertical support channels therein, said U-shaped sections being defined by a flat bottom having upper and lower surfaces and a pair of vertical legs extending upwardly from opposite ends of said flat bottom, said lower surface of said flat bottom being adapted to be supported by the planar deck surface; said elongated channel further comprising a pair of stablizing projections, each of said projections extending laterally outwardly and downwardly from one of said vertical legs, each of said stablizing projections terminating in a planar deck surface engaging end which is in coplanar relationship with said lower surface of said flat bottom.

37. The enclosure of claim 36 wherein at least the lower end of each of said vertically extending support channels is rectangular in cross section, said rectangular lower end having a first pair of sides in close confronting relationship with the inner facing sides of said pair of vertical legs and a second pair of parallel sides extending between the inner faces of said pair of vertical legs; and, wherein said means for structurally supporting and for interconnecting comprise: a right angle shaped bracket having a first section in confronting relationship with said upper surface of said flat bottom and extending between said inner surfaces of said vertical legs and a second vertically extending section in confronting relationship with one of said second pair of sides; and means for structurally interconnecting said vertically extending section of said right angled bracket to said one side of said second pair of sides in which it is in confronting relationship; and a threaded fastening means extending through an opening provided in said first section of said right angled bracket downwardly through an axially aligned opening in the bottom of said U-shaped section and into structural positive engagement with the planar structural deck surface.

38. The enclosure of claim 36 wherein said elongated channel comprises an extrusion made from structural aluminum.

39. The enclosure of claim 1 wherein said enclosure base support structure has at least one break therein and wherein means for providing access comprises an access door, said door being pivotally supported by one of said vertically extending support channels and extending from the planar structural deck surface upwardly to a position adjacent said upper enclosure perimeter.

40. The enclosure of claim 1 wherein said flexible plastic material comprises a translucent, reinforced vinyl material.

* * * * *